US005233324A

United States Patent [19]

Beihoff et al.

[11] Patent Number: 5,233,324

[45] Date of Patent: Aug. 3, 1993

[54] CURRENT TRANSFORMER FOR SENSING CURRENT IN AN ELECTRICAL CONDUCTOR

[75] Inventors: Bruce C. Beihoff, Wauwatosa; Francis W. Camps, Milwaukee; Scot F. Peret, Jackson, all of Wis.

[73] Assignee: Eaton Corporation, Cleveland, Ohio

[21] Appl. No.: 857,854

[22] Filed: Mar. 26, 1992

[51] Int. Cl.[5] ..... H01F 27/24; H01F 40/06

[52] U.S. Cl. ..... 336/83; 336/174; 336/178; 336/212; 336/234

[58] Field of Search ..... 336/174, 175, 212, 233, 336/234, 83, 213, 178

[56] References Cited

U.S. PATENT DOCUMENTS

| | | | |
|---|---|---|---|
| 1,287,982 | 7/1918 | Hartley | 336/83 |
| 1,471,263 | 10/1923 | Hobart | 336/83 |
| 1,561,782 | 11/1925 | Given | 336/83 |
| 1,624,560 | 4/1927 | Payne | 336/83 |
| 1,735,092 | 11/1929 | Roller | 336/175 |
| 2,878,425 | 3/1959 | Kudoh | 336/83 |
| 3,683,302 | 8/1972 | Butler et al. | 336/212 |
| 4,210,859 | 7/1980 | Meretsky et al. | 336/214 |
| 4,639,610 | 1/1987 | Del Vecchio et al. | 307/83 |
| 4,814,735 | 3/1989 | Williamson | 336/192 |
| 4,823,437 | 5/1989 | Williamson | 336/192 |
| 4,855,703 | 8/1989 | Bessho et al. | 335/296 |
| 4,857,874 | 8/1989 | Bessho et al. | 335/296 |
| 4,879,539 | 11/1989 | Bessho | 335/299 |
| 4,901,048 | 2/1990 | Williamson | 336/180 |

FOREIGN PATENT DOCUMENTS

| | | | |
|---|---|---|---|
| 727240 | 5/1943 | Fed. Rep. of Germany | 336/213 |
| 141959 | 5/1980 | Fed. Rep. of Germany | 336/175 |

*Primary Examiner*—Thomas J. Kozma
*Attorney, Agent, or Firm*—L. G. Vande Zande

[57] ABSTRACT

A wire-wound bobbin serves as the core of a current transformer. A magnetic material flux path is disposed on the core that encircles the core coincident with the coils of the bobbin at least once and radially encircles the cross section of the core at lest once. The magnetic flux path comprises an assembly of distinct magnetic members positioned on the core and held in place by tape or the like.

13 Claims, 3 Drawing Sheets

CURRENT TRANSFORMER FOR SENSING CURRENT IN AN ELECTRICAL CONDUCTOR

BACKGROUND OF THE INVENTION

This invention relates to current transformers which are utilized to detect the presence of a current in a conductor and to produce an analog signal proportional to the magnitude of the current. A continuous goal in the development of current transformers is to reduce the physical size thereof while at the same time increase the current range which may be sensed and lower the cost of manufacture of the current transformer. This invention is related to these goals.

SUMMARY OF THE INVENTION

The invention provides a wound core having a central opening adapted to receive the electrical conductor through the opening. Current flowing through the conductor will generate a magnetic flux having a cylindrical pattern around the conductor. However, such pattern will be coincident with the core windings and will cut no turns of the core, and therefore no transformer action will take place. The invention provides a magnetic path on the core which coincides with the winding of the core to completely encircle the conductor at least once and extends radially to completely encircle a cross section of the winding at least once. Flux in the magnetic path induced by current in the conductor will cut all the turns of the coil to produce an induced secondary current. The invention preferably provides a wire-wound bobbin core.

DETAILED DESCRIPTION OF THE PREFERRED EMBODIMENTS

Figure 1:
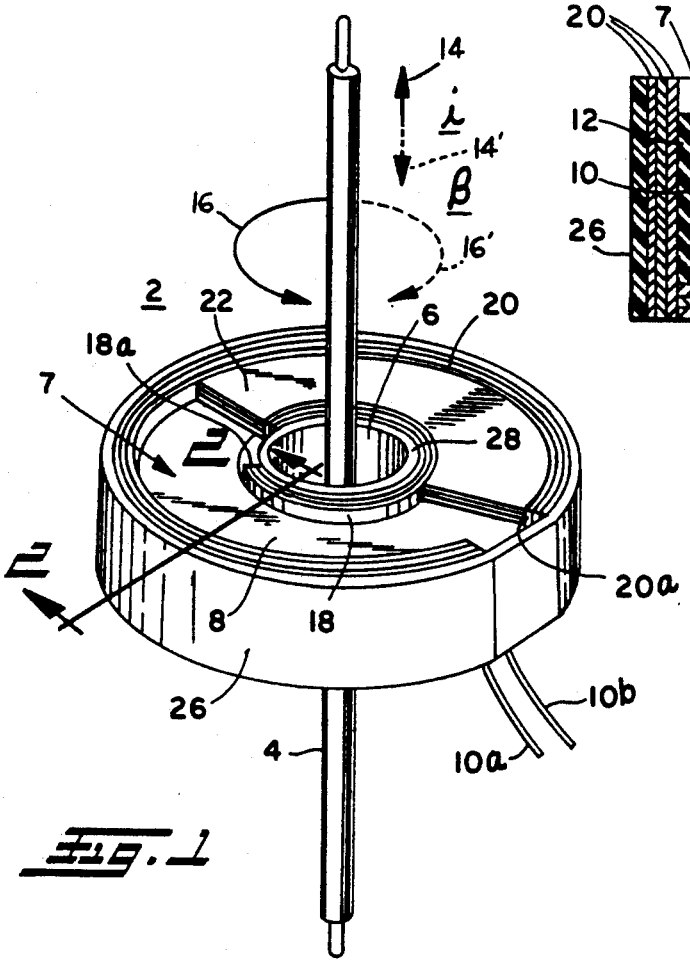
FIG. 1 is an isometric view of the current transformer of this invention with an electrical wire conductor extending coaxially therethrough.
Figure 2:
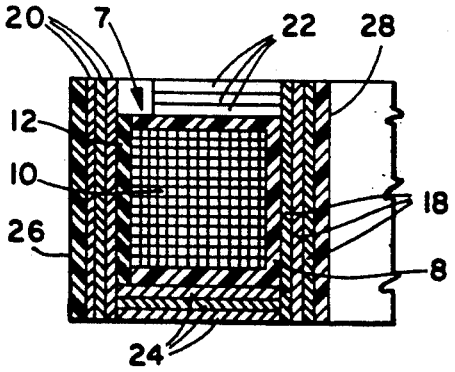
FIG. 2 is a partial cross section of the current transformer of this invention taken along the line 2—2 in FIG. 1.

The current transformer 2 of this invention is isometrically shown in FIG. 1 wherein a length of insulated wire conductor 4 extends axially through a central opening 6 of current transformer 2. Referring also to FIG. 2, current transformer 2 preferably comprises a wire-wound bobbin core 7 which consists of a plastic or the like insulating bobbin 8 which is wound with multiple turns of electrical conducting wire 10 such as transformer wire or the like. It is to be understood that the wound conductor may be a flat ribbon, or may be wire wound on a form other than a bobbin However, a wound-wire bobbin has a greater fill-factor than other forms of winding, providing a very high "turn" count, and is less expensive to wind than other forms. A rubber or vinyl insulating tape 12 is wound around the outer perimeter of coil 10 and bobbin 8 to retain the coil wire 10 in place on the bobbin and to provide protection and electrical insulation for the coil. Opposite ends **10*a* and 10*b* (FIG. 1) of wire 10 are brought out of the coil and bobbin 8 at a single location for connection to means for measuring the analog output of the coiled wire 10. When conductor 4 is disposed through the central opening 6 of the current sensor 2, current i flowing in conductor 4 in either direction according to arrows 14 or 14' will induce a flux $\beta$ in a circular (cylindrical) pattern around conductor 4 as represented by arrows 16 or 16', respectively. It will be appreciated that arrows 16 or 16' are in the same direction and plane as the coils of wire 10** of the core and therefore the flux $\beta$ creates no transformer action because it cuts no conductor coils.

Figure 3:
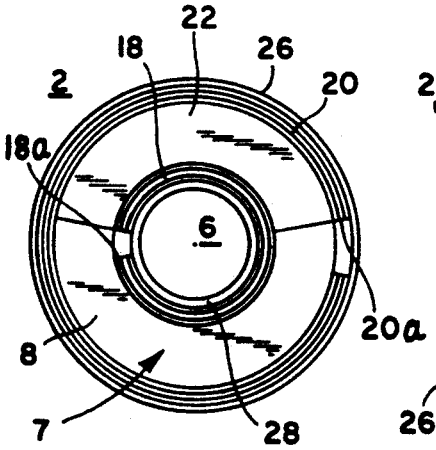
FIG. 3 is a top view of the current transformer shown in FIG. 1.
Figure 4:
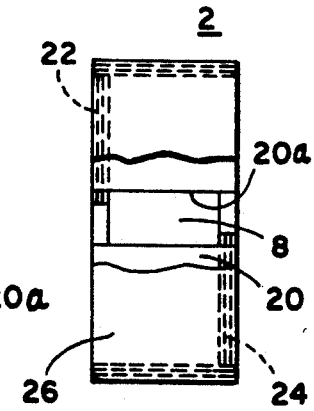
FIG. 4 is a side elevation view of the current transformer shown in FIG. 3.
Figure 5:
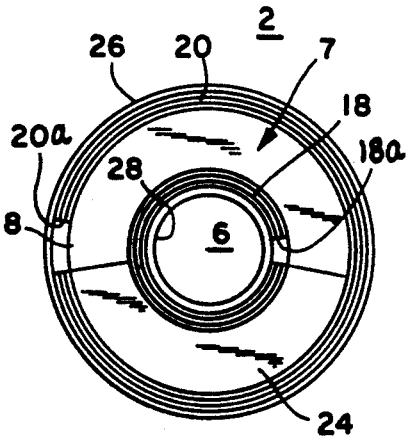
FIG. 5 is a bottom view of the current transformer as shown in FIG. 3.

According to this invention, a closed magnetic material flux path is provided on the wire-wound core to direct the flux $\beta$ in a path that will completely encircle conductor 4 and will radially completely encircle the coils of wire 10. The magnetic material path comprises a plurality of magnetic members which are arranged in a predetermined abutting order. To enhance the magnetic characteristics, each member is preferably made of three laminations, but for ease of discussion will be referred to herein as a single member. To fabricate the members in three laminations, it is preferable that the sheets of magnetic material be laminated in the three layers first, bonded together with an adhesive (e.g. Permabond 240 made by Permabond International of Englewood, N.J.), and then cut as a laminated assembly from the bonded sheets so as to maintain a reasonable degree of precision for all laminations at the butt contact surfaces with other members. Referring also to FIGS. 3–6, the magnetic members comprise a substantially circular inner lamination 18 having a gap **18*a*, a substantially circular outer lamination 20 having a gap 20*a*, and top and bottom laminations 22 and 24, respectively. Top and bottom laminations 22 and 24 are essentially identical arcuate segments of less than 180° length and are oppositely disposed as seen in FIGS. 3 and 5. It will also be noticed in FIGS. 3 and 5 that the inner and outer laminations 18 and 20 are disposed to have their respective gaps 18*a* and 20*a* arranged in diametrically opposed relationship with the ends of top and bottom laminations 22 and 24 terminating adjacent the respective gaps 18*a* and 20*a*. A piece of tape 26 encircles outer lamination 24 to provide electrical insulation for the lamination and to hold the lamination to the core 7. Similarly, a piece of tape 28 lines the interior of inner lamination 18 to provide an insulated central opening 6 for the current transformer 2** of this invention.

Figure 6:
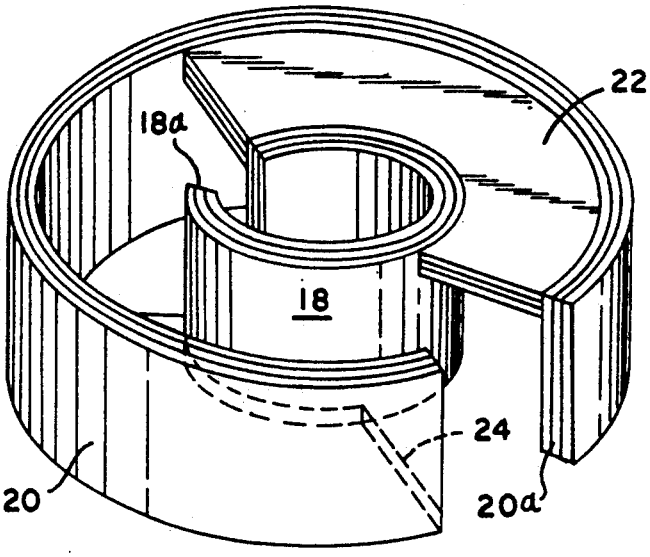
FIG. 6 is an isometric view of members making up the magnetic path of the current transformer shown in FIGS. 1–5.
Figure 7:
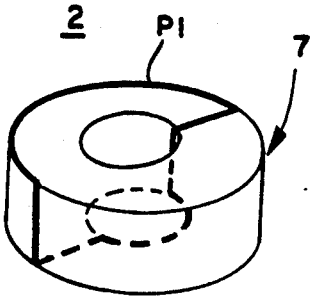
FIG. 7 is an isometric outline view of the current transformer of FIGS. 1–6 with a magnetic flux path illustrated thereon.

Referring particularly to FIGS. 6 and 7, the magnetic flux path established by the magnetic members 18–24 is shown on the outline drawing of the current transformer in FIG. 7. The flux path extends within the outer lamination 20 to top lamination 22, radially inward along top lamination 22 to inner lamination 18, along the inner lamination to bottom lamination 24, outwardly along bottom lamination 24 to outer lamination 20, thereby making a complete loop around the central opening 6 and a complete, generally radially extending loop around the coils of wire 10. This flux path is illustrated as P1 on the coil in FIG. 7.

Figure 8:
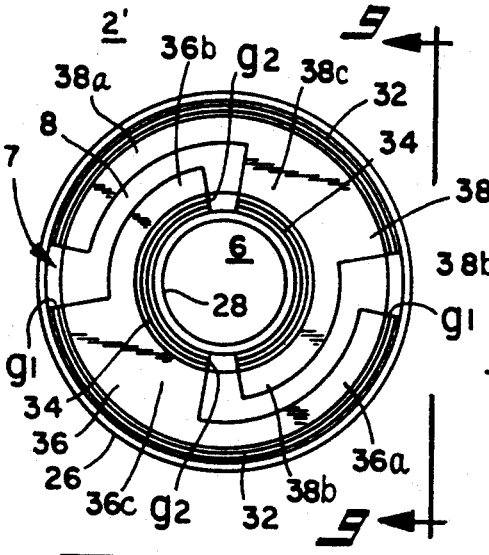
FIG. 8 is a top view of an alternate embodiment of the current transformer of this invention.
Figure 9:
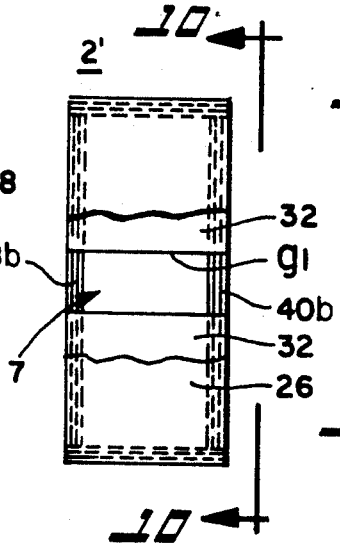
FIG. 9 is a side elevation view of the current transformer shown in FIG. 8.
Figure 10:
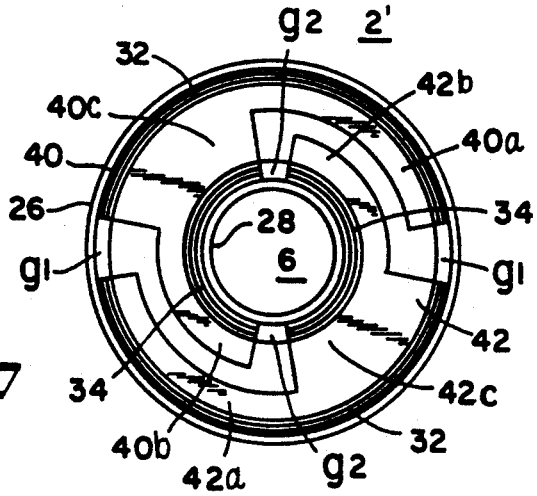
FIG. 10 is a bottom view of the current transformer shown in FIG. 8.
Figure 11:
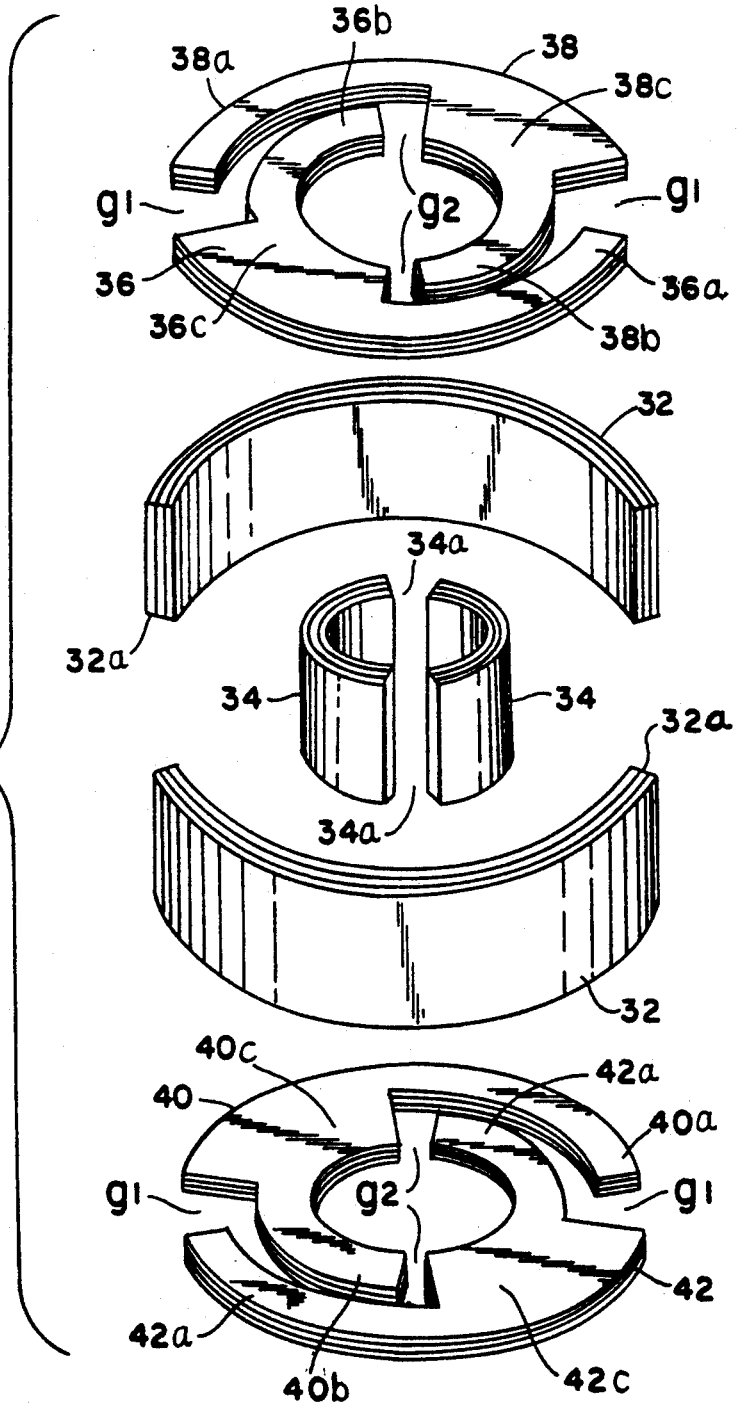
FIG. 11 is an exploded isometric view of members making up the magnetic path for the alternate version current transformer shown in FIGS. 8–10.
Figure 12:
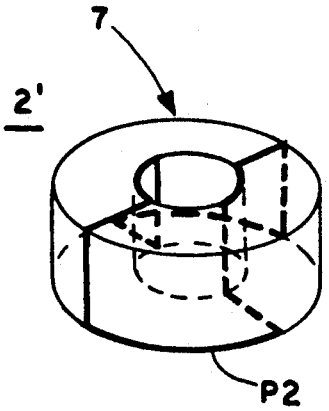
FIG. 12 is an isometric outline view of the current transformer of FIGS. 8–11 with the magnetic flux path of the magnetic elements shown in FIG. 11 illustrated thereon.

An alternate version 2' of the current sensor of this invention is shown in FIGS. 8–12 wherein a modification of the magnetic members provides two turns of the flux path around the coils of wire 10. As seen best in FIG. 11, inner and outer generally circular laminations 32 and 34, respectively, comprise separate arcuate strips which, when positioned to the bobbin wound core 7 have two diametrically opposed gaps each, **32*a* and 34*a*, respectively The top and bottom laminations each comprise two identical members 36, 38 and 40, 42, respectively. As in the foregoing description, each magnetic member preferably comprises three separate laminations as shown, but will be referred to as a single member in the description. In essence, all four members 36, 38, 40 and 42 are identical but have been given different numbers to facilitate the description. However, only the structural features of lamination member 36 will be described, using alpha subscripts which apply equally to the members 38, 40 and 42. Member 36 comprises an outer arcuate segment 36*a* which is less than 180° in length, and an inner arcuate segment 36*b* which is also less than 180° in length. The inner and outer arcuate segments are rotationally offset 90° and are interconnected by a web 36*c* which extends approximately, but less than 90° in arcuate length. When top lamination members 36 and 38 are positioned on the top of the bobbin wound core 7, the adjacent ends of respective outer arcuate segments 36*a* and 38*a* form a pair of diametrically opposed gaps g1 as do the respective ends of inner arcuate segments 36*b* and 38*b*, the latter gaps g2 being offset 90° from the first mentioned gaps g1. As seen in FIGS. 8 and 10, the inner laminations 34 are disposed within the center opening of the wire wound core 7, and the outer laminations 32 are disposed around the periphery of the core. The outer laminations 32 abut the outer arcuate segment 36*a*, 38*a*, 40*a* and 42*a* of the respective top and bottom laminations 36–42. Similarly, the inner laminations 34 abut the respective inner arcuate segments 36*b*, 38*b*, 40*b*, and 42*b*, with the gaps 34*a* aligned with the gaps g2 in the inner arcuate segments of top and bottom laminations and the gaps 32*a* being aligned with the gaps g1** in outer arcuate segments of the top and bottom laminations.

This alternate magnetic material flux path forms two complete loops around the coils of wire 10 and one complete loop around the conductor 4. This flux path is illustrated on the isometric view of core 7' shown in FIG. 12, wherein the path extends along one of the outer laminations 32 to top lamination outer arcuate segment **38*a*, inwardly through web 38*c* to inner arcuate portion 38*b*, downwardly through one of the inner laminations 34 to arcuate portion 42*b*, outwardly through web 42*c* to outer portion 42*a* into an oppositely disposed outer lamination 32, upwardly to outer arcuate portion 36*a* of top lamination 36, inwardly through web portion 36*c* to inner web portion 36*b*, downwardly through inner lamination 34 to inner arcuate portion 40*b*, outwardly through web portion 40*c* to outer arcuate portion 40*a* and back into the first mentioned outer lamination 32. Thus the flux path makes one complete loop around central opening 6 and a conductor 4 disposed therethrough and two complete loops radially around the coils of wire 10' of core 7'**.

The foregoing has described an improved current transformer for use as a current sensor to detect and measure current flowing in a wire conductor. The overall size and cost of the current transformer is greatly reduced by providing a wire-wound bobbin as a core and redirecting magnetic flux from a circular path coincident with the coils of wire to a radial path that encircles the coils of wire. Improved sensitivity can be obtained by an alternate version of magnetic members which create a magnetic path that encircles the coils of wire 10 twice in series. It is to be understood that this invention is susceptible of various modifications without departing from the scope of the appended claims. For example, although the magnetic path has been described as comprising several discrete magnetic members, it is contemplated that a flexible magnetic material could be wound upon the core, or that magnetic material could be deposited in a prescribed path on the core by various spraying or coating methods.

We claim:

1. A current transformer comprising:

a bobbin having an opening extending between opposite ends along an axis of said bobbin;

a conductor wound on said bobbin about said axis providing a multi-turn coil on said bobbin; and magnetic means disposed on said bobbin and coil wound thereon defining a directed closed loop flux path encircling said axis and radially encircling said coil at substantially a right angle to turns of said conductor, said magnetic means comprising:

an inner segment disposed within said opening and having opposite ends defining a gap, said inner segment partially enclosing said axis;

an outer segment disposed circumferentially on said bobbin and having opposite ends defining a gap, said outer segment partially enclosing said axis, said inner and outer segments being complementally oriented on said bobbin and coil t cooperatively fully enclose said axis; and first and second end segments respectively disposed at said opposite ends of said bobbin extending radially between and magnetically linking said inner and outer segments, said first end segment interconnecting said inner and outer segments at one respective side of said gaps, and said second end segment interconnecting said inner and outer segments at an opposite respective side of said gaps.

2. The current transformer defined in claim 1 wherein said magnetic flux path established by said magnetic means encircles said second electrical conductor multiple times.

3. The current transformer defined in claim 1 wherein said magnetic flux path established by said magnetic means encircles said second electrical conductor two times.

4. A current transformer comprising:

a conductor comprising a multi-turn coil having an opening extending therethrough along an axis of said coil; and magnetic means disposed on said coil establishing a directed closed-loop magnetic flux path encircling said axis and radially encircling conductors of said multi-turn coil, said magnetic means comprising:

a cylindrical inner magnetic member disposed within said opening and having an axially oriented magnetic gap in a wall thereof;

a cylindrical outer magnetic member disposed circumferentially on said coil and having an axially oriented magnetic gap in a wall thereof disposed opposite said magnetic gap in said inner magnetic member;

a top magnetic member comprising a circular disc segment disposed in abutting relation with said inner and outer magnetic members, said top magnetic member extending annularly from said magnetic gap in said inner magnetic member to said magnetic gap in said outer magnetic member; and a bottom magnetic member comprising a circular disc segment disposed in abutting relation with said inner and outer magnetic members, said bottom magnetic member extending annularly from said magnetic gap in said inner magnetic member to said magnetic gap in said outer magnetic member, said bottom magnetic member further being disposed opposite said top magnetic member.

5. The current transformer defined in claim 4 wherein said flux path extends annularly along said outer magnetic member to said top magnetic member, radially along said top magnetic member to said inner magnetic member annularly along said inner magnetic member to said bottom magnetic member, and radially along said bottom magnetic member to said outer magnetic member.

6. The current transformer defined in claim 1 wherein said magnetic segment comprise a plurality of magnetic members, said magnetic members being disposed in abutting relation to define a magnetic flux path encircling said axis and radially encircling said conductor at a right angle to turns of said conductor.

7. A current transformer comprising: a conductor comprising a multi-turn coil having an opening extending therethrough along an axis of said coil; and magnetic means disposed on said coil establishing a directed closed-loop magnetic flux path encircling said axis and radially encircling conductors of said multi-turn coil comprising:

A first pair of substantially semi-cylindrical magnetic members disposed within said central opening of said coil, ends of said first pair of magnetic members being spaced apart to provide a pair of diametrically opposed magnetic gaps;

a second pair of substantially semi-cylindrical magnetic members disposed on an outer circumference of said coil, ends of said second pair of magnetic members being spaced apart to provide a pair of diametrically opposed magnetic gaps;

a pair of top magnetic members each comprising a generally semi-cylindrical flat plate having an outer arcuate portion and an inner arcuate portion rotationally offset at substantially right angles to said outer arcuate portion and a web portion radially joining overlapping ends of said outer and inner arcuate portions, said inner arcuate portion abutting one of said first pair of substantially semi-cylindrical magnetic members and said outer arcuate portion abutting one of said second pair of substantially semi-cylindrical magnetic members; and a pair of bottom magnetic members identical to said pair of top magnetic members, said bottom magnetic members being reversely oriented relative to said top magnetic members such that a respective bottom magnetic member having an outer arcuate portion abutting one of said second pair of substantially semi-cylindrical magnetic members in common with an outer arcuate portion of a respective top magnetic member has an inner arcuate portion abutting a different one of said first pair of substantially semi-cylindrical magnetic members than an inner arcuate portion of said respective top magnetic member abuts;

said magnetic means providing a closed magnetic loop encircling said first electrical conductor and two magnetic loops serially encircling said second electrical conductor.

8. The current transformer defined in claim 6 wherein said magnetic members comprise a plurlaity of preformed magnetic elements arranged on said bobbin and coil in contiguous relation.

9. The current transformer defined in claim 8 wherein said preformed magnetic elemetns comprise:

a cylindrical inner magnetic member disposed within said opening and having an axially oriented magnetic gap in a wall thereof;

a cylindrical outer magnetic member disposed circumferentially on said core and having an axially oriented magnetic gap in a wall thereof disposed opposite said magnetic gap in said inner magnetic member; and top and bottom circular disc segments disposed in abutting relation with said inner and outer magnetic members, said top and bottom circular disc segments extending annularly from said magnetic gap in said inner magnetic member to said magnetic gap in said outer magnetic member, said top and bottom segments being oriented at respective opposite sides of said coil and bobbin.

10. The current transformer defined in claim 8 wherein said elements comprise multiple laminations.

11. The current transformer defined in claim 10 wherein said multiple laminations are bonded together.

12. The current transformer defined in claim 11 wherein said multiple laminations are cut from sheets of magnetic material bonded together by an adhesive.

13. The current transformer defined in claim 10 wherein portions of said elements abut portions of other said elements.

* * * * *

UNITED STATES PATENT AND TRADEMARK OFFICE

CERTIFICATE OF CORRECTION

PATENT NO. : 5,233,324

DATED : August 3, 1993

INVENTOR(S) : Bruce C. Beihoff, et al

It is certified that error appears in the above-indentified patent and that said Letters Patent is hereby corrected as shown below:

Title page, Column 2, line 4, reference "4,823,437" should be —4,833,437—.

Column 4, line 47, "t" should be —to—.
Column 5, line 36, "segment" should be —segments—.
Column 5, line 48, "A" should be —a—.

Signed and Sealed this

Fifth Day of September, 1995

*Attest:*

*Attesting Officer*

BRUCE LEHMAN

*Commissioner of Patents and Trademarks*